United States Patent [19]

Stafford

[11] 4,340,161

[45] Jul. 20, 1982

[54] WALLPAPER PREPARATION BOARD

[76] Inventor: William G. Stafford, 2584 Dublin Dr., Salt Lake City, Utah 84119

[21] Appl. No.: 214,125

[22] Filed: Dec. 8, 1980

Related U.S. Application Data

[63] Continuation of Ser. No. 49,738, Jun. 18, 1979, abandoned.

[51] Int. Cl.[3] ..... B26F 3/02

[52] U.S. Cl. ..... 225/18; 225/79; 225/82; 269/295; 269/307; 269/308; 248/460

[58] Field of Search ..... 269/295, 307–308, 269/254 R; 225/78, 77, 79, 82; 30/314; 108/28, 32; 248/460, 461, 633

[56] References Cited

U.S. PATENT DOCUMENTS

| | | | |
|---|---|---|---|
| 655,855 | 8/1900 | Cushman | 269/302.1 |
| 909,599 | 1/1909 | Hotchkiss | 225/77 |
| 1,532,019 | 3/1925 | Zimmerman | 269/295 |
| 2,043,133 | 6/1936 | Walter | 30/314 |
| 2,588,092 | 3/1952 | Duff | 269/254 R |
| 3,291,354 | 12/1966 | Ziebarth | 225/79 |
| 4,026,219 | 5/1977 | Shupe et al. | 108/13 |

FOREIGN PATENT DOCUMENTS

| | | | |
|---|---|---|---|
| 648510 | 1/1951 | United Kingdom | 225/18 |
| 656290 | 8/1951 | United Kingdom | 269/295 |

*Primary Examiner*—Robert C. Watson

*Attorney, Agent, or Firm*—Terry M. Crellin; B. Deon Criddle

[57] ABSTRACT

A wallpaper preparation board made of low cost rigid sheet material such as cardboard, paperboard, thin wooden, metal, or plastic sheets, etc., is formed from a plurality of substantially flat panels of the sheet material which are hingedly attached end-to-end to form an elongate board which can be folded in accordion style into a compact unit. A pair of hooks 11 and 12 are provided at the top of the board, with the hooks being adapted to engage the top of a door or the edge of the top landing of a ladder, so that the board can hang downwardly from the door or the top of the ladder. A pair of ears project upwardly at opposite sides of the upper end of the board to receive the opposite ends of a rod which is inserted through a roll of wallpaper. A knife edge extends across the board near the roll of wallpaper to aid in cutting lengths of wallpaper which are withdrawn from the roll. Wallpaper withdrawn from the roll is readily pasted and trimmed as it lays against the preparation board prior to its being cut from the roll.

12 Claims, 8 Drawing Figures

Fig. 2
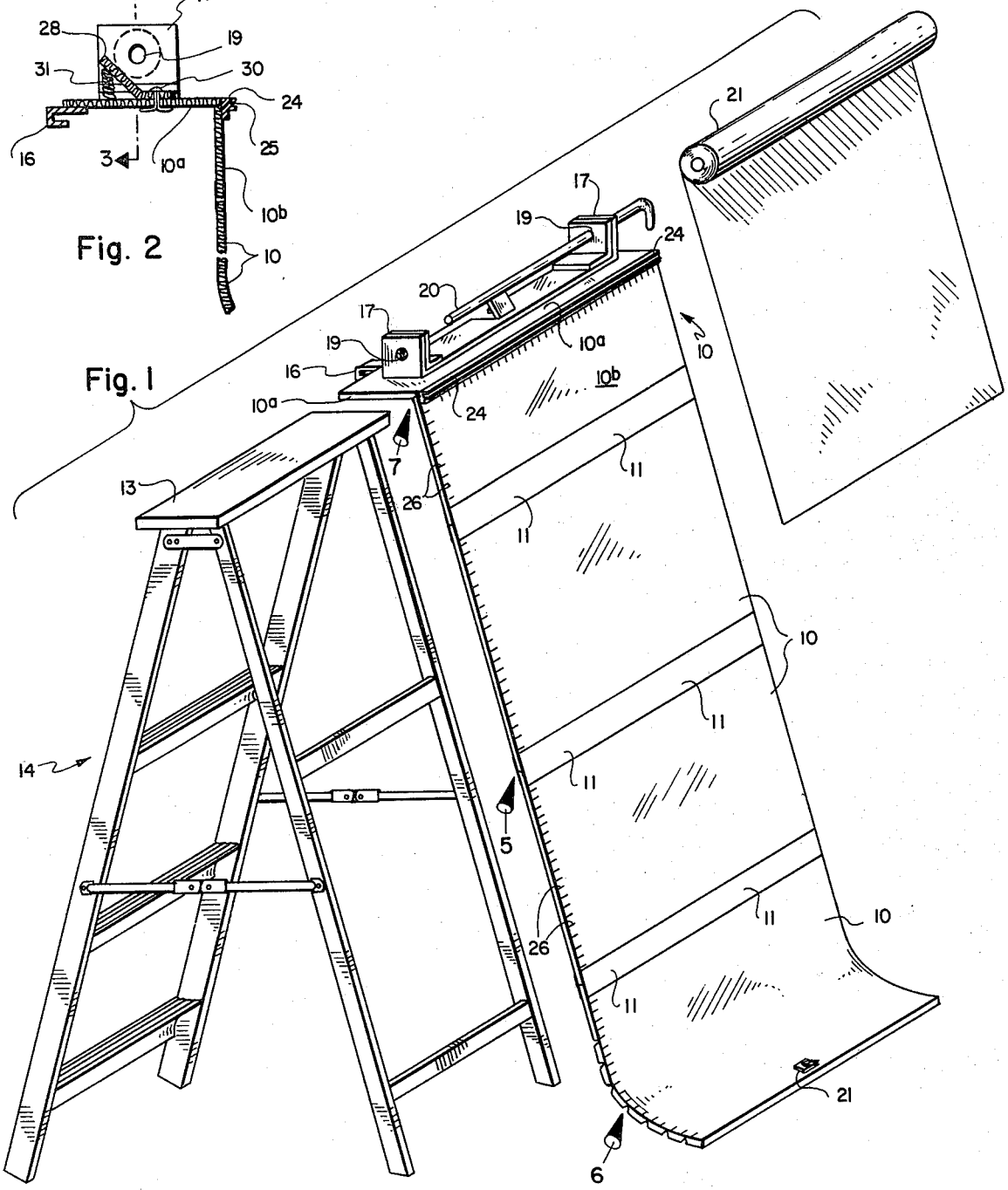
Fig. 1
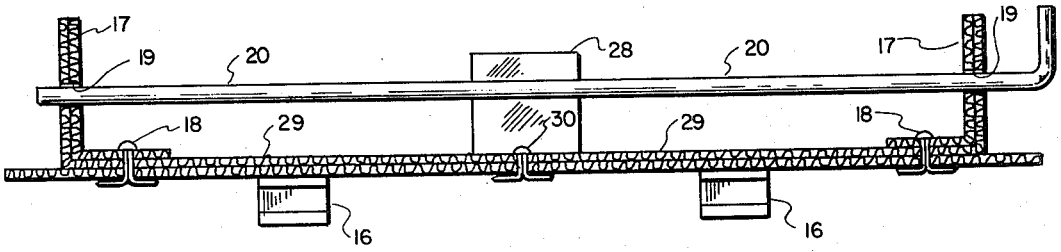
Fig. 3

WALLPAPER PREPARATION BOARD

This is a continuation of application Ser. No. 49,738 filed on June 18, 1979 now abandoned.

BACKGROUND OF THE INVENTION

1. Field:

The present invention pertains to methods and apparatus used in preparing lengths of wallpaper for application to a wall. In particular, the invention relates to apparatus for cutting particular lengths of wallpaper from a roll and applying paste to the backside of the lengths of wallpaper.

2. State of the Art:

Various methods and apparatus have been suggested in the prior art for measuring, cutting, and pasting lengths of wallpaper prior to application of the lengths to a wall. Generally, the apparatus comprised different type tables upon which lengths of cut wallpaper were placed face down. Paste was applied to the backside of each strip, and when selvedge edges were common, means were provided for cutting the selvedge edge from the lengths of wallpaper. Examples of such apparatus for measuring and cutting wallpaper are shown in U.S. Pat. Nos. 491,488; 526,038; 1,695,766; 2,588,092; and 2,043,133.

3. Objectives:

A principal objective of the present invention is to provide an inexpensive wallpaper preparation board which can be folded up along its length in accordion style folds so as to form a compact unit which is conveniently distributed in commerce, easily stored, and readily used by persons who are inexperienced as well as experienced in the art of hanging wallpaper. An additional objective of the present invention is to provide a wallpaper preparation board which can be suspended from a ladder or door, and need not be used with or formed into a space consuming table.

SUMMARY OF THE INVENTION

The above objectives are achieved in accordance with the present invention by providing an elongate, wallpaper preparation board comprising a plurality of substantially flat, rigid panels made of a sheet material such as cardboard, thin wood sheets, sheet metal, or sheets of plastic. The panels are hingedly attached in end-to-end relationship. The board can be folded in accordion style into a compact unit whose perimeter dimensions is substantially the same as the perimeter of the component panels.

A pair of hooks are provided at the upper end of the elongate preparation board, and the hooks are adapted to engage the top of a door or the edge of the top landing of a ladder. The panel at the top of the elongate, hinged board is preferably divided into two sections which are hingedly connected together. The uppermost section of the top panel has a depth in the direction of the elongate board sufficient to rest on the top landing of the ladder. The remaining portion of the top panel and the remaining panels in the board are unfolded and draped down the front of the ladder. The hooks provided on the uppermost section of the top panel are secured over the rear edge of the top landing of the ladder to securely hold the preparation board in place on the ladder. The preparation board can also be hung from the top of a door, with the hooks secured over the top of the door and the panels comprising the board being unfolded and draped down along the door.

A pair of ears project upwardly from the surface of the elongate board at opposite sides thereof, respectively. The ears are positioned next to the top end of the elongate board on the first panel thereof. Each ear has an opening or bore through the thickness thereof. The openings in the ears are adpated to receive the opposite ends, respectively, of an elongate rod, and the rod is adapted to be inserted through a roll of wallpaper, so that the roll is mounted between the ears at the top end of the preparation board, whereby lengths of wallpaper can be withdrawn from the roll along the preparation board.

In using the preparation board in preparing lengths of wallpaper for hanging, the wallpaper is withdrawn from the roll at the top of the board, and the face of the length of withdrawn wallpaper is positioned against the flat preparation board which is suspended from the top of a ladder or top of a door. Paste is applied to the exposed backside of the length of wallpaper. The length of wallpaper is then cut from the roll of wallpaper at the top of the preparation board. A knife edge or guide is provided extending across the board adjacent to the roll of wallpaper to aid in cutting the pasted length of wallpaper from the roll. Indicia in the form of a ruler is provided along the length of the board on one side or both sides thereof to allow accurate measurement of the lengths of wallpaper as they are withdrawn from the roll at the top of the preparation board.

The preparation board of the present invention makes the heretofor messy pasting of lengths of wallpaper relatively simple and easy and abrogates the use of a bulky table or of unrolling the wallpaper on the floor. The job of preparing the lengths of wallpaper for hanging becomes simple and easily handled, which results in fewer pasting and other preparation mistakes.

Additional objects and features of the invention will become apparent from the following detailed description taken together with the accompanying drawings.

THE DRAWINGS

A preferred embodiment of the invention representing the best mode presently contemplated of carrying out the invention is illustrated in the accompanying drawings, in which:

FIG. 1 is an exploded pictorial of the preparation board as it is used with a ladder;

FIG. 2 is a vertical section through the preparation board;

FIG. 3 is a cross-sectional view taken on line 3—3 of FIG. 2;

DETAILED DESCRIPTION OF THE ILLUSTRATED EMBODIMENT

Figure 5:
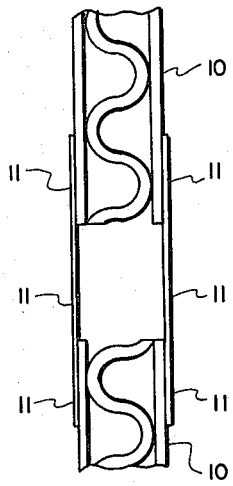
FIG. 5 is an enlarged fragmentary vertical view of the hinge connection between adjacent panels of the preparation board as shown at arrow 5 in FIG. 1.

Referring to the drawings, a wallpaper preparation board in accordance with this invention is shown comprising a plurality of substantially flat, rigid panels 10 made of a sheet material such as double sided corregated cardboard. The panels 10 are hingedly attached end-to-end, so that adjoining panels can be folded over each other. As best shown in FIG. 5, the adjoining panels 10 are spaced slightly from each other and connected together by strips of tape 11 extending across the gap between the adjacent panels 10 holding the panels together. In order for the panels 10 to be adapted to fold back or forward over each other, the space between the adjoining ends of the panels 10 is at least the combined thickness of the two panels 10 which are connected together. The panels 10 can be made of other rigid sheet materials such as thin sheets of plastic, metal, and wood. The plastic, metal, or wood panels can be hingedly connected together using strips of tape in a manner similar to that shown in the drawings. Alternatively, the panels, including cardboard panels 10 as shown in the drawings, could be attached together using common hinge members. Generally, hinges will allow adjacent panels to be folded over each other in only one direction, and to provide for accordion type folding of the panels, the hinges on adjacent joints must be placed on opposite sides of the board.

Figure 8:
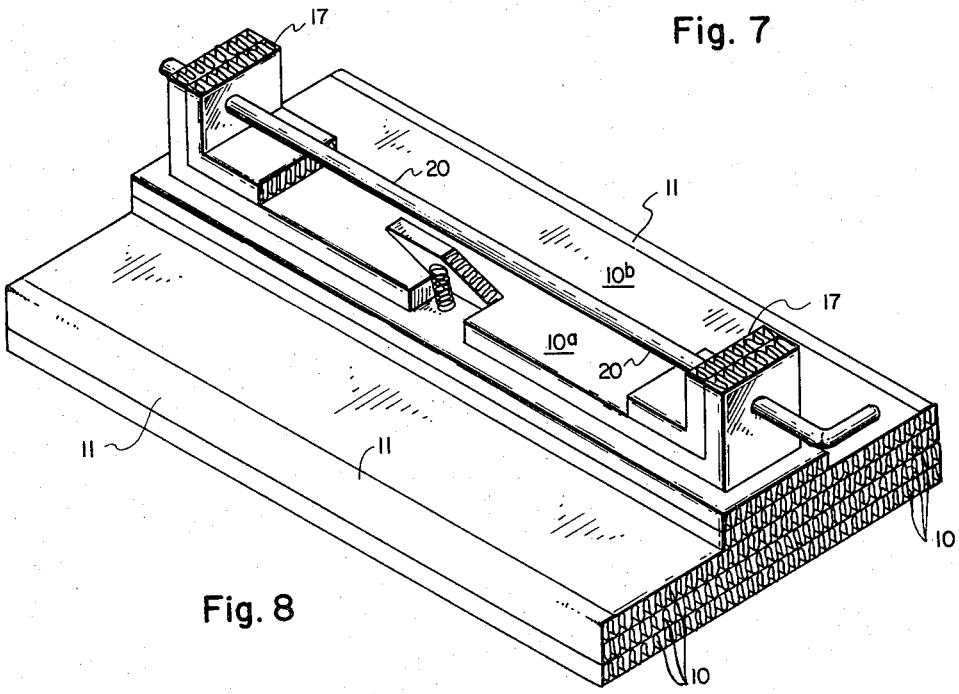
FIG. 8 is a pictorial of the preparation board of FIG. 1 showing the board in its folded position.

As mentioned above, the panels 10 are attached in end-to-end relationship in such manner that the series of panels 10 forming the elongate board can be folded in accordion style into a compact unit as shown in FIG. 8. In folding the elongate board, the lowermost panel is folded in either direction so as to lie flat against the surface of the adjoining panel. The two side-by-side panels are then folded as a unit in the opposite direction from that in which the lowermost panel was folded, so that the two side-by-side panels lie flat against the surface of next adjoining panel. Folding is continued in a similar manner with faces of adjacent panels lying face-to-face in the folded unit. As shown in FIG. 8, the unit has an outer perimeter substantially the same as that of one of the component panels 10.

Figure 6:
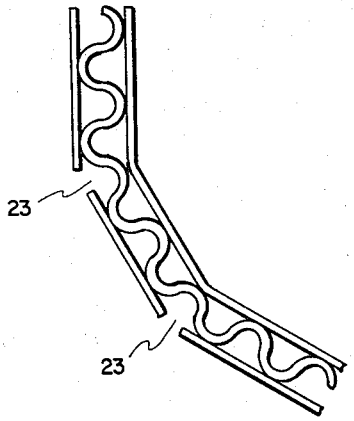
FIG. 6 is an enlarged fragmentary vertical view of the lower end portion of the preparation board showing how the lower end portion can be formed into a substantially curved surface as shown at arrow 6 in FIG. 1.

In the preferred embodiment shown in the drawings, the topmost panel 10 is divided into two sections 10*a* and 10*b*, wherein 10*a* has a depth, i.e., distance from its top edge to its edge which is hingedly attached to section 10*b*, sufficient to rest upon the top landing 13 of a ladder 14 as shown in FIG. 1. It has been found advantageous to make the depth of the top section 10*a* between at least about 4 inches and about 8 inches. The other section 10*b* of the top panel and the remaining panels 10 unfold and are draped down the front of the ladder 14 to form an elongate, substantially flat preparation board. As shown in FIG. 6, the upper section 10*a* of the first panel is connected to the lower section 10*b* by a strip of tape 15 extending from one side of the panel to the other. The tape joint formed between the upper and lower sections 10*a* and 10*b* permit the upper section 10*a* to be folded flat against the backside of section 10*b* when the board is folded into its compact unit form as shown in FIG. 8.

A pair of hooks 16 are attached to the upper end of the elongate preparation board to secure the board to the ladder 14. The hooks 16, in the illustrated embodiment, are attached to the upper edge of the uppermost section 10*a* of the first panel. The hooks 16 engage the rear edge of the top landing 13 of ladder 14 and securely hold the elongate preparation board in place on the ladder 14. The preparation board can be used with a door as its support in place of the ladder 14. In such usage, the hooks 16 are attached over the top of a door and all the panels, including the top section 10*a* of the first panel, hang down from the door.

A pair of ears 17 project upwardly from the surface of the elongate board on opposite sides thereof, respectively. The ears 17 are positioned next to the top end of the board, and as illustrated, they project upwardly from the top section 10*a* of the top panel. Preferably, each of the ears 17 are formed by a section of double thick cardboard which has been bent into an angle or L shape. One leg of each of the respective L-shaped members is affixed to the surface of the uppermost section 10*a* of the top panel. Advantageously, the legs of the L-shaped members are glued to the section 10*a*, and, as shown, a prong fastener 18 can be pushed through the legs and the section 10*a* to reinforce the glued joint. The ears 17 have aligned openings 19 therein which are adapted to receive the respective ends of an elongate rod 20 extending therebetween.

The elongate rod 20 is adapted to be inserted through a roll of wallpaper 21, and to support the roll of wallpaper 21 between the ears 17 so that the roll 21 can rotate about the rod 20. When the roll of wallpaper 21 is correctly positioned on rod 20, lengths of wallpaper can be withdrawn from the roll 21 and pulled along the preparation board. A clip 22 is provided at the bottom of the preparation board to hold the leading edge of the withdrawn length of wallpaper to the board, if desired. Preferably, the clip 22 is positioned adjacent to the lowermost end of the bottom panel of the panels 10 forming the preparation board.

Inasmuch as it is often desirable to prepare lengths of wallpaper longer than the height of the ladder being used or a door in the room, the lowermost panel in the series of panels 10 is adapted to form a curved surface which curves into the floor. Thus, lengths of paper can be withdrawn from the roll 21 which extend down the preparation board and on to the floor. The curved portion is easily provided in the bottom panel of the board by forming a series of slot like members therein which are hingedly attached to each other so that the panel can be formed into a curved surface. As shown in FIGS. 1 and 6, the slotlike members are readily formed by cutting parallel grooves 23 across the width of the bottom panel on the underneath side thereof. The grooves 23 do not extend into the top layer of the cardboard, and, thus, the panel can be curved away from the grooves 23 as best shown in FIG. 6. When lengths of wallpaper are withdrawn from the roll 21 sufficient in length to run on to the floor, the curved surface of the preparation board forms a steady transition surface so that a fold is not formed in the paper. Pasting of the wallpaper in the area of the curved surface is readily achieved.

Figure 7:
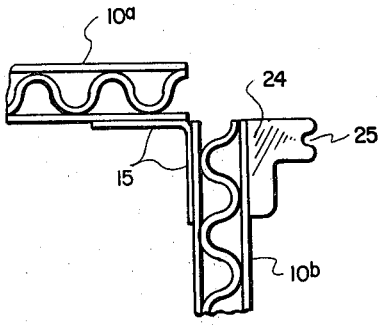
FIG. 7 is a fragmentary, enlarged vertical view of the corner section of the board in the vicinity of the top landing of the ladder as shown at arrow 7 in FIG. 1.

A straightedge or other cutting guide is provided at the top end of the preparation board for cutting the withdrawn lengths of wallpaper from the roll 21. As shown in FIGS. 1, 2 and 7, a knife edge 24 extends across the preparation board near the pair of ears 17. Preferably, the knife edge 24 is located along the upper edge of the second section 10*b* of the top panel of the board. The knife edge 24 is advantageously made of extruded plastic and has a channel 25 formed therein which extends longitudinally along the knife edge 24.

The channel 25 forms a convenient guide for directing a knife across the sheet of wallpaper.

Indicia 26 is placed along the length of the board for measuring the length of wallpaper which is withdrawn from the roll 21. As shown in FIG. 1, the indicia 26 marks off feet and inches along one side of the board. The indicia could be marked on both sides of the board if so desired, as well as along a line down the center of the board. Additional indicia 27 (FIG. 1) can be provided across the width of the board, preferably adjacent to the knife edge 24. The cross board indicia 27 is useful in cutting the length of wallpaper into strips which are not as wide as the wallpaper on the roll 21. The width of the preparation board is somewhat larger than the widths of conventional wallcovering materials. The term "wallpaper" as used throughout the specification and claims is meant to be inclusive of all conventional wallcovering materials which are applied to the wall in thin, flexible strips. Preferably, the preparation board has a width of between about 30 inches and about 36 inches.

Figure 4:
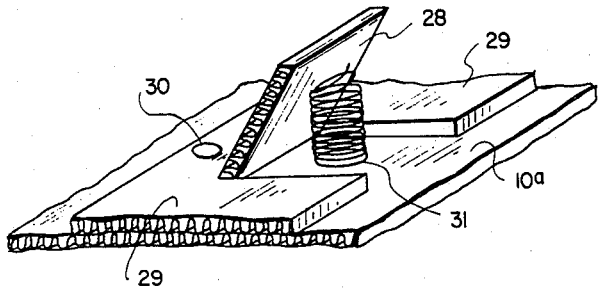
FIG. 4 is a fragmentary pictorial view of the wallpaper roll tensioning device which is incorporated into the preparation board.

In the preferred embodiment of the preparation board as illustrated in the drawings, a tension member is provided for biasing the roll 21 of wallpaper against freely unrolling as the lengths of material are withdrawn therefrom. The tension member advantageously comprises a flap 28 pivotally attached to the preparation board adjacent to the rod 20 which extends between the ears 17. The flap 28 is adapted to be pivoted outwardly and downwardly into contact with the surface of a roll of wallpaper 21 on the rod 20. The flap 28 is conveniently cut from a strip of cardboard 29 (FIGS. 3 and 4) which extends substantially across the width of the preparation board. The strip 29 is advantageously bent upwards at its opposite ends to form part of the ears 17. As best seen in FIG. 3, reinforcing strips of cardboard are fixed to the opposite end portions of the strip 29 and form part of the ears 17. Referring to FIGS. 2 and 4 in particular, the flap 28 is seen to be conveniently cut from the upper portion of the strip 29 of cardboard at a position between the ears 17. As shown, the flap 28 is positioned substantially midway between the ears 17. The uncut bottom portion of the strip 29 at the base of the flap 28 is firmly attached to the surface of the preparation board. Preferably, the strip 29 is glued to the preparation board, and a prong fastener 30 is pushed through the strip 29 cardboard at the base of the flap 28 to reinforce the glued joint. The flap 28 is pivoted outwardly and downwardly about its base, and compressable spring means 31 is attached between the flap 28 and the preparation board to bias the flap 28 in its position pivoted outwardly and downwardly about its base. When a roll of wallpaper is positioned on the rod 20 between the ears 17, the flap 28 is spring biased into contact with the surface of the roll of wallpaper.

With the preparation board as shown and described, lengths of wallpaper are readily pulled from the roll 21. The spring biased flap 28 provides an automatic braking system for the roll 21, so that excess paper is not realed from the roll 21. The length of withdrawn wallpaper lies face down against the preparation board. Pasting of the exposed backside of the length of wallpaper is easily and readily accomplished, as are other preparations such as trimming the length of wallpaper to desired size. The length of wallpaper is then cut from the roll 21 and is ready for being applied to a wall.

Although a preferred embodiment of the invention has been illustrated and described, it is to be understood that various variations are possible without departing from the subject matter coming within the scope of the following claims, which subject matter is regarded as the invention.

I claim:

1. A wallpaper preparation board comprising a plurality of substantially flat, rigid panels of sheet material, said panels being hingedly attached end-to-end to form an elongate wallpaper preparation board which can be folded in accordion style into a compact unit, with the panels being adapted to be folded back and forth so that adjacent panels lie face-to-face in the folded unit and the folded unit has an outer perimeter substantially the same as that of the component panels;

means for supporting a roll of wallpaper near the upper end of the elongate preparation board so that lengths of wallpaper can be withdrawn from the roll along the preparation board; and a knife edge extending across the preparation board near the means for supporting the roll of wallpaper to aid in cutting the lengths of wallpaper which are withdrawn from the roll.

2. A wallpaper preparation board in accordance with claim 1, wherein indicia is provided along the length of the board for measuring the length of wallpaper which is withdrawn from the roll.

3. A wallpaper preparation board in accordance with claim 1, wherein the top panel in the series of panels is divided into two sections which are hingedly connected together, with the uppermost section having said hooks attached thereto and being adapted to rest on the top landing of a ladder with said hooks engaged to the rear edge of the top landing of the ladder, wherein the rest of the preparation board is unfolded and draped down the front of the ladder.

4. A wallpaper preparation board in accordance with claim 1, wherein the last panel in series of panels comprises a series of slot like members hingedly attached so that they can form a curved surface between the preparation board and the floor.

5. A wallpaper preparation board in accordance with claim 1, wherein a clip member is provided on the last panel at the lower end of the preparation board for holding the leading end of the length of wallpaper in place at the lower end of the preparation board.

6. A wallpaper preparation board in accordance with claim 1, wherein a tension member is provided for biasing the roll of wallpaper from freely unrolling as the lengths of wallpaper are withdrawn therefrom.

7. A wallpaper preparation board in accordance with claim 6, wherein the means for supporting the roll of wallpaper comprises a pair of ears projecting upwardly from the surface of the board at opposite sides thereof, respectively, said ears being positioned next to said upper end of the preparation board, with each ear having an opening or bore through the thickness thereof, and an elongate rod which is adapted to be inserted through a roll of wallpaper, with the respective ends of the rod extending from the opposite ends of the roll of wallpaper and through the respective openings in said ears, so that the roll of wallpaper is supported between the ears on said rod.

8. A wallpaper preparation board in accordance with claim 7, wherein the tension member comprises a flap pivotally attached to the preparation board adjacent to the rod which extends between the openings in the ears, said flap being pivoted outwardly and downwardly into contact with the surface of a roll of wallpaper on said rod; and spring means is provided for biasing the flap member to pivot outwardly and downwardly from the preparation board into contact with the roll of wallpaper.

9. A wallpaper preparation board in accordance with claim 7, wherein the panels are made of cardboard.

10. A wallpaper preparation board in accordance with claim 9, wherein the panels are hingedly attached to each other with adhesive tape.

11. A wallpaper preparation board in accordance with claim 1, including means for attaching the upper end of the elongate preparation board to an elevated support such as a ladder or door.

12. A wallpaper preparation board in accordance with claim 11, wherein the means for attaching the board to an elevated support comprises a pair of hooks attached to the upper end of the board.

* * * * *